United States Patent [19]

Johnsen

[11] Patent Number: 4,931,708

[45] Date of Patent: Jun. 5, 1990

[54] INDEPENDENT BAND SPRING DOOR GEAR MOTOR OPERATOR

[76] Inventor: Thore Johnsen, 2976 Islip Ct., Wantagh, N.Y. 11793

[21] Appl. No.: 417,509

[22] Filed: Oct. 5, 1989

[51] Int. Cl.[5] ..... E06B 9/08; E06B 9/72

[52] U.S. Cl. ..... 318/466; 160/133

[58] Field of Search ..... 318/630, 466; 160/133, 160/201, 310, 311, 313

[56] References Cited

U.S. PATENT DOCUMENTS

| | | | |
|---|---|---|---|
| 2,626,375 | 1/1953 | Fischer | 160/331 X |
| 3,853,167 | 12/1974 | Wardlaw | 160/133 |
| 4,342,354 | 8/1982 | Leivenzen et al. | 160/133 |
| 4,392,392 | 7/1983 | Perisic et al. | 160/133 X |
| 4,501,963 | 2/1985 | Perisic | 160/133 X |
| 4,665,965 | 5/1987 | Pasquier et al. | 160/133 X |
| 4,690,195 | 9/1987 | Taylor | 160/133 X |
| 4,706,727 | 11/1987 | Leivenzon et al. | 160/310 X |
| 4,721,146 | 1/1988 | Wardlaw | 160/310 |
| 4,800,946 | 1/1989 | Rosenoy | 160/133 X |

FOREIGN PATENT DOCUMENTS

| | | | |
|---|---|---|---|
| 2904462 | 8/1980 | Fed. Rep. of Germany | 160/133 |
| 0700549 | 1/1966 | Italy | 160/133 |

*Primary Examiner*—Bentsu Ro

*Attorney, Agent, or Firm*—Michael I. Kroll

[57] ABSTRACT

A power assist device for raising and lowering an independent band spring door is disclosed. The present invention includes a prime mover, an operator controlling the prime mover, a band spring cage, and a roller chain gear set mechanically connecting the operator to the band spring cage so that there is no back lash in the gear set.

15 Claims, 3 Drawing Sheets

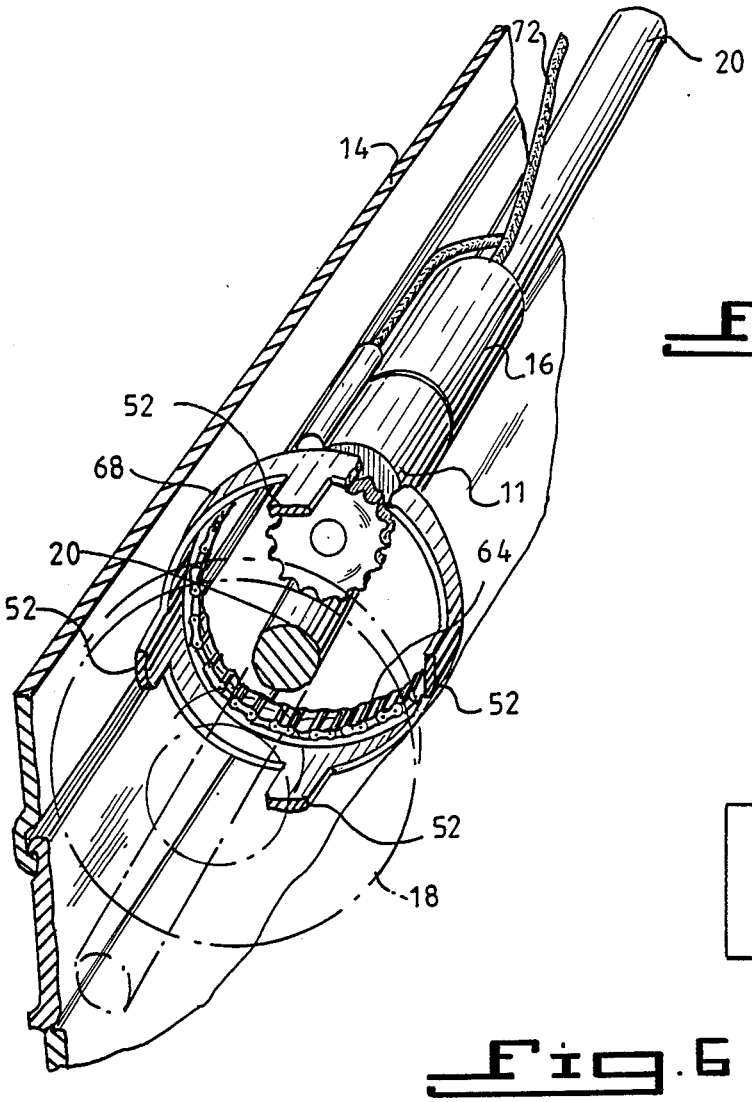
Fig. 7
Fig. 6
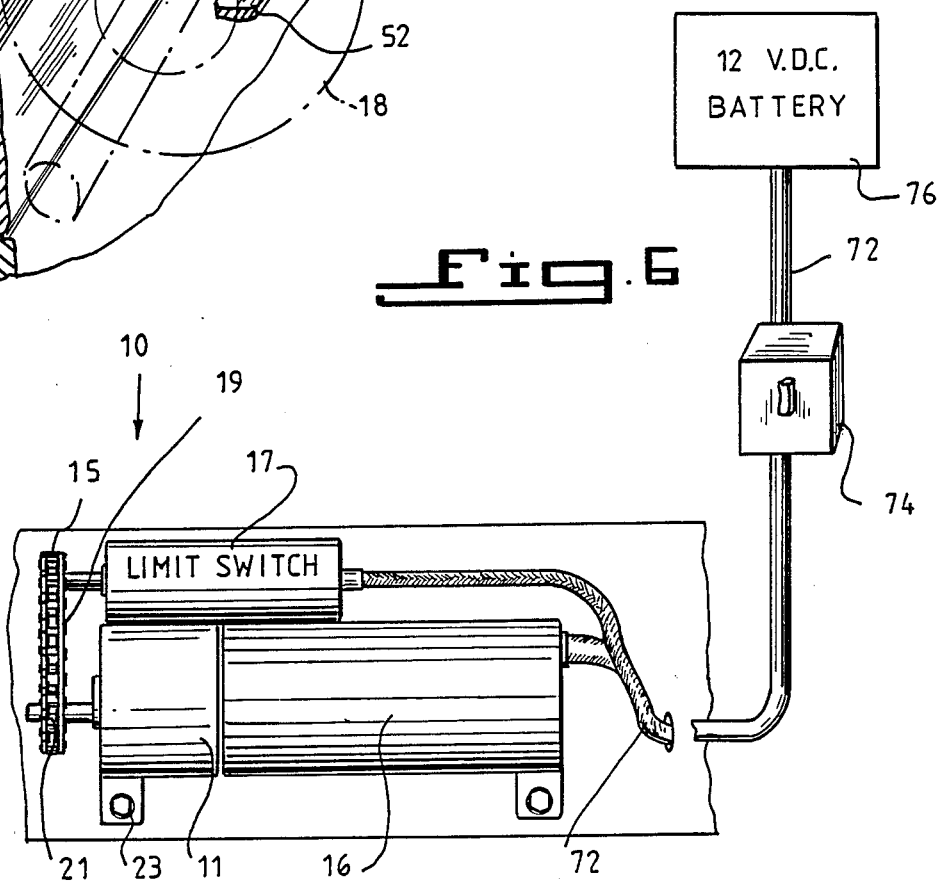

INDEPENDENT BAND SPRING DOOR GEAR MOTOR OPERATOR

BACKGROUND OF THE INVENTION

1. Field of the Invention:

The present invention relates to a door gear motor operator.

More particularly, the present invention relates to an independent band spring door gear motor operator.

2. Description of the Prior Art:

Gear motor operators can be adapted to most independent push up band spring doors. By the use of gear motor operators, the strenuous task of manually lifting and pulling down the door is eliminated.

On larger doors, such as bay doors, which use torsion spring axles, a coil spring is incorporated inside the axle pipe. A shaft is welded to the inside of the pipe and protrudes through the end plate and is powered by a chain and sprocket arrangement. This results in the turning of the axle pipe which lifts and lowers the door, as required.

In solution, the U.S. Pat. No. 1,943,371 to Cross relates to end locks for fire doors of the rolling shutter type.

When automatic door openers are provided on doors, such as garage doors it has found to be undesirable to provide a key locking system for the door wherein the door is mechanically locked on operation of the key. This feature has become more undesirable when the automatic door opener is a radio controlled automatic door opener. The reason for the undesirable provision of a key locking means is that once the door is key locked the automatic door opener can be accidentally or unwantingly placed in operation to open the door. If this occurs, then the electric motor used to open the door become locked and thus the motor draws a stalling current. This current is sufficient to burn out the motor and as a consequence initiate a fire.

The U.S. Pat. No. 4,452,292 to Leivenzon et al. relates to an automatic opening means for a door, and a key locking facility which mechanically locks the door in a closed position.

In solution, the U.S. Pat. No. 4,721,146 to Wardlaw relates to driving mechanisms permitting the safe operation of the door in either the manual drive or motor drive mode.

Rolling doors may be constructed as exemplified by the U.S. Pat. No. 2,820,516 and include operating mechanisms as exemplified by the U.S. Pat. Nos. 3,637,004, 3,853,167 and 2,934,139.

To operate roller doors by means of chain and sprocket mechanisms are not very satisfactory in that they require periodic service, are noisy to operate, and require regular lubrication.

To control the operation of the roller door or shutter by electrical means, two such electrically operated mechanisms are described in the Australian Pat. Application Nos. AUA 30718/77 in the name of B.W.N. Industries PTY. LTD. and 44163/79 in the name of Byrne and Davidson Doors (NSW) PTY. Limited.

In solution, the U.S. Pat. No. 4,392,392 to Perisic et al. relates to the operating mechanism by which the door or shutter curtain can be wound onto or unwound from its supporting drum wheels so as to open and close same.

The electric motor and its associated gear train rotates, as a body, simultaneously with the door curtain supporting drum wheels and by having the electric motor housed within the core of the door curtain.

In the art of garage door operator mechanisms it has been necessary for an installer of the operator to accurately adjust the upper and lower limit stops of the door so that power to the driving motor can be removed when the door reaches those positions. Usually this adjustment involves correctly locating limit stop switches on the door frame in the door opened and door closed positions so that when the door reaches those positions the driving motor can be switched off. Alternatively, screw threaded adjustments have been provided which are arranged on a movable part of an operator mechanism so as to switch off the fixed position limit switch of the respective opened and closed positions. A typical example of such operator mechanism is disclosed, for example, in the Australian Pat. No. 528,744.

Other forms of operators which are used for "tilt-up" or "lift-up" doors are disclosed, for example, in U.S. Pat. Nos. 3,439,727 and 4,107,877. U.S. Pat. No. 3,439,727 discloses a chain drive system. The U.S. Pat. No. 4,107,877 uses a similar carriage member, but instead of having a chain drive it has a screw thread which rotatably and screw threadably engages with the carriage.

In both U.S. Pat. No. 3,439,727 and the U.S. Pat. No. 4,107,877 for the "lift-up" or "tilt-up" doors, complicated adjusting means are provided for the setting of the opened and closed positions of the door so that power to the motor can be removed when the door reaches those positions.

In solution, the U.S. Pat. No. 4,706,727 to Leivenson et al. relates to a door operator for use in domestic garage doors of the "roll-up" type or the "tilt-up" or "lift-up" type.

In solution, the U.S. Pat. No. 3,739,832 to Sivin relates to an overhead grille capable of emergency ascending movement from its closed position so as to provide an emergency or exit opening beneath its lower edge.

It has been the practice heretofore in raising and lowering heavy closures to employ counterbalancing devices for facilitating movement thereof. Such devices in the art have torsional springs that are wound up as the closure descends, allowing setting up an increased potential force when the closure reaches its ultimate descent. This force assists in lifting the closure upon manually raising the same, the spring unwinding with decreasing force as the closure is rolled upon its drum. Counterbalancing devices employing torsional type springs, however, are unsatisfactory, particularly in view of the heavy steel wire that is required and also in view of the end connections therefor. Attempts have been made to overcome these disadvantages by utilizing the expansive and contractive force of springs but these have also been unsuccessful.

In solution, the U.S. Pat. No. 2,543,711 to Schultz relates to vertically movable closures for door and window openings.

The following U.S. patents disclose structures known in the relevant art: U.S. Pat. No. 3,595—May 25, 1844, U.S. Pat. No. 330,956—Nov. 24, 1885, U.S. Pat. No. 1,022,939—Apr. 9, 1912, U.S. Pat. No. 2,513,042—Jun. 27, 1950, U.S. Pat. No. 2,545,400—Mar. 13, 1951, U.S. Pat. No. 2,906,323—Sept. 29, 1959, U.S. Pat. No.

3,065,785—Nov. 27, 1962, and U.S. Pat. No. 4,010,790—Mar. 8, 1977.

In solution, the U.S. Pat. No. 4,301,851 to Gitkin relates to a combined roller shutter and awning for a door assembly such as a sliding glass door arrangement providing access between the interior of a building.

Numerous innovations for door motor operators have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide an independent band spring door gear motor operator that avoids the disadvantages of the prior art.

More particularly, it is an object of the present invention to provide an independent band spring door gear motor operator of the present invention that eliminates the need for torsion springs, heavy axles, and shafts. This reduces the cost factor by a substantial amount. Furthermore, the size and weight of the door determines the amount of flat springs needed. If necessary, more than one gear motor can be used.

In keeping with these objects, and with others which will become apparent hereinafter, one feature of the present invention resides, briefly stated, in a power assist device for raising and lowering an independent band spring door, and having prime mover means, means for controlling the prime mover means, a band spring cage, and means for mechanically connecting the control means to the band spring cage.

In accordance with another feature of the present invention, prime mover means include a gear motor.

Another feature of the present invention is that the gear motor is a 12 volt direct currrent electrical gear motor.

Yet another feature of the present invention is that the controlling means include a gear motor operator.

Still another feature of the present invention is that the mechanical connecting means include a roller chain set.

Yet still another feature of the present invention is that the roller chain set has a roller chain and a sprocket.

Still yet another feature of the present invention is that it further comprises an axle pipe having a first end and a second end and on which the small 12 volt direct current electrical motor, the motor operator, and the band spring cage are colinearly mounted.

Another feature of the present invention is that it further comprises a first end plate and a second end plate in which the axle pipe is fixed.

Yet another feature of the present invention is that it further comprises a first band spring arrangement, a second band spring arrangement, and a third band spring arrangement mounted on the axle pipe.

Still another feature of the present invention is that the first band spring arrangement is disposed intermediate the first end plate and the band spring cage while the second band spring arrangement is disposed intermediate the second end plate and the 12 volt direct current electrical gear motor.

Yet still another feature of the present invention is that the first band spring arrangement the second band spring arrangement and a third band spring arrangement, each have a plate with a substantially disposed throughbore through which the axle pipe passes.

Still yet another feature of the present invention is that the axle pipe contains three spring arrangements each further having a flat coil band spring with an end that is bolted on to the axle pipe.

Another feature of the present invention is that the roller chain has a plurality of fingers extending therefrom and in the direction of and terminating on the band spring cage.

Yet another feature of the present invention is that the band spring cage has a plurality of horizontal straps which are the connection straps disposed between the two halves of the band spring cage, and also the connection point of the travel end of the band spring.

Still another feature of the present invention is that the band spring cage has a plate on which the plurality of fingers of the roller chain terminate.

Yet still another feature of the present invention is that the gear motor operator has a shaft on which the pinion gear sprocket is rotatably mounted.

Still yet another feature of the present invention is that the plate contains a central throughbore through which the axle pipe passes.

Another feature of the invention is that the plurality of fingers extending from the ring gear roller chain is variable depending upon the diameter of the band spring cage, size, and type of roller chain.

Yet another feature of the present invention is that the plurality of horizontal straps of the band spring cage is five.

Still another feature of the present invention is that it further comprises a power switch, a transmitter, in addition to the manual back up.

Another feature of the present invention is that it can be adapted to any independent band spring door without modification to existing band spring cages, due to the use of a planetary roller chain instead of a conventional planetary gear set, with teeth that will not stand up to the up and down and side to side shifting problem. The planetary roller chain is guided by the gear motor operator sprocket thus preventing shifting and or disengagement of planetary roller chain.

Another feature of the present invention is that it contains limit switches that automatically control the travel distance of door opening and closing.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 6 is a side view of the electrical apparatus utilized by the present invention; and FIG. 7 is a perspective view of the present invention.

LIST OF REFERENCE NUMERALS UTILIZED IN THE DRAWING

Figure 1:
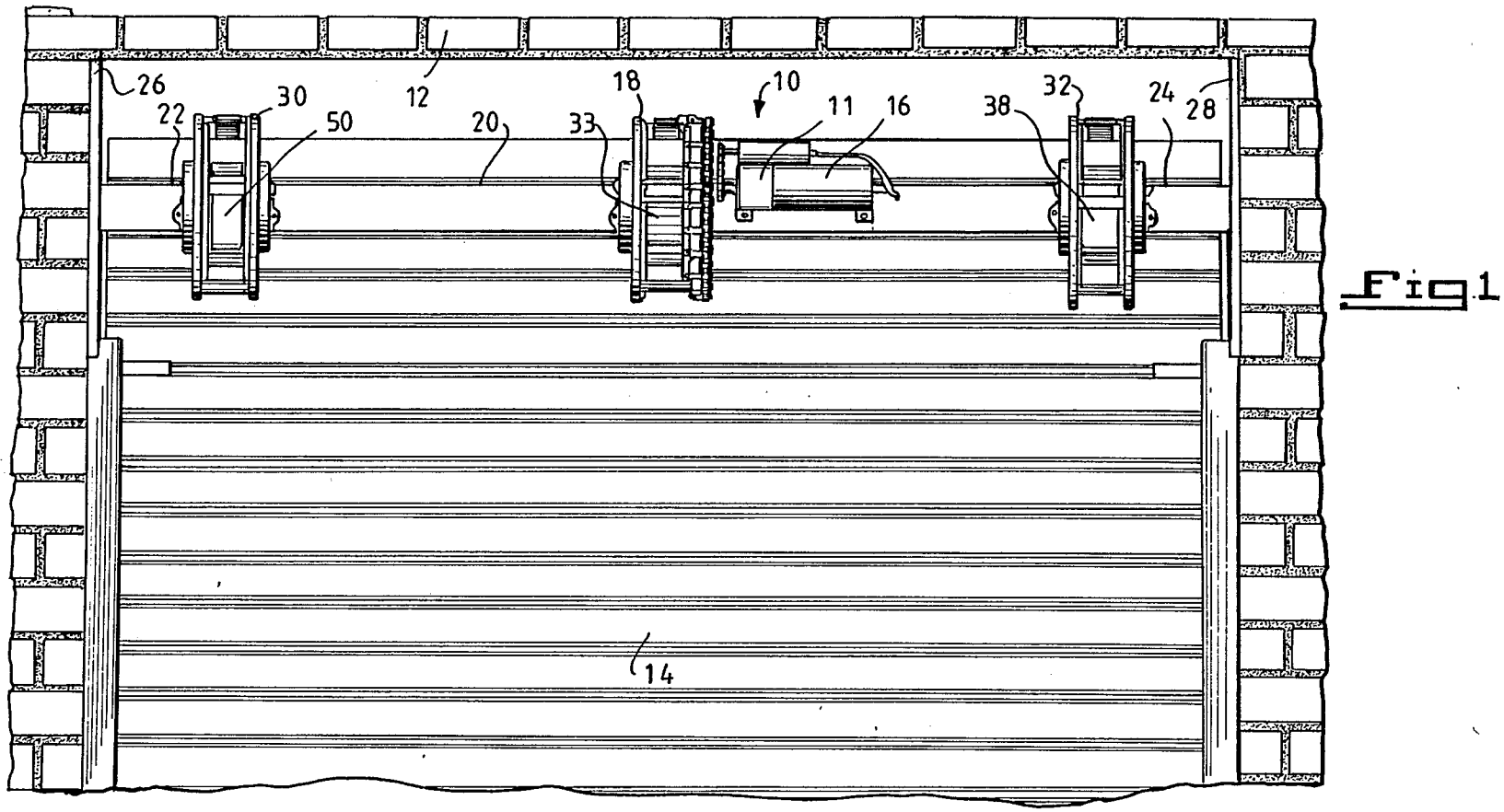
FIG. 1 is a head on view of the present invention being utilized to push up and down a conventional independent curtain mounted to a store.

10—independent band spring door gear motor operator of the present invention
11—gear head of the independent band spring door gear motor operator 10
12—store front mounting the independent band spring door motor operator 10
14—independent band spring door located on the store front 12
15—limit switch slave gear sprocket
16—12 volt direct current motor included in the independent band spring door motor operator 10
17—limit switch device enclosure
18—band spring cage included in the independent band spring door gear motor operator 10
19—limit switch roller chain
20—axle pipe for colinearly receiving the gear motor 16, the gear motor operator 11, and the band spring cage
21—limit switch master gear sprocket
22—first end of the axle pipe 20
23—gear motor mounting bolt
24—second end of the axle pipe 20
26—end plate for receiving the first end 22 of the axle pipe 20
28—end plate for receiving the second set 24 of the axle pipe 20
30—band spring cage disposed between the end plate 26 and the independent band spring door gear motor operator 10
32—band spring cage disposed between the end plate 28 and the independent band spring door gear motor operator 10
33—flat coil band spring of the band spring cage 18
34—end plate of the band spring arrangement 32
35—end plate of the band spring cage 18
36—central throughbore in the end plate 34
37—central throughbore in the end plate 34
38—flat coil band spring of the band spring cage 32
40—fixed end of the flat coil band spring 38
41—fixed end of the flat coil band spring 33
42—tongue of the fixed end 40
43—tongue of the fixed end 33
44—bolt on in the axle pipe 20 for receiving the fixed end
45—bolt on in the axle pipe 20 for receiving the fixed end
46—end plate of the band spring cage 30
48—central throughbore in the end plate 46
50—flat coil band spring of the band spring cage 30
52—plurality of fingers extending from the ring gear roller chain 64
53—fixed end of the flat coil band spring 50
54—tongue of the flat coil band spring 50
56—bolt in the in the axle pipe 20 for receiving the fixed end
57—"S"—hook connecting door to the band spring cage
58—intermediate portion of the independent band spring door gear motor operator 10
60—horizontal strap of the band spring cage
62—plate providing the closing side for the band spring cage 18
64—ring gear roller chain of the independent band spring cage 18
66—shaft of the gear motor operator 11
68—pinion gear sprocket mounted to the shaft 66
70—throughbore in the plate 62
72—power cord for the independent band spring door gear motor operator 10
74—operating power switch for the independent band spring door gear motor operator 10
76—12 volt direct current battery

DETAILED DESCRIPTION OF THE PREFERRED EMBODIMENT

Referring now to FIG. 1, the independent band spring door gear motor operator is shown generally at 10, mounted to a store front 12, and operating a push up and a push down independent band spring door 14.

The independent band spring door gear motor operator 10 includes a small 12 volt direct current electric motor 16, a gear head 11, and a band spring cage 18. The gear motor 16, the gear motor operator 11, and the band spring cage 18 are all mounted colinearly on an axle pipe 20.

The axle pipe 20 has a first end 22 and a second end 24. The first end 22 of the axle pipe 20 mounts into an end plate 26. While the second end 24 of the axle pipe 20 mounts into another end plate 28. The end plate 26 and the end plate 28 are fixed and function as journals for the axle pipe 20.

Intermediate the end plate 26 and the independent band spring door gear motor operator 10 is disposed a band spring arrangement 30.

Intermediate the end plate 28 and the independent band spring door gear motor operator 10 is disposed another band spring arrangement 32.

Figure 2:
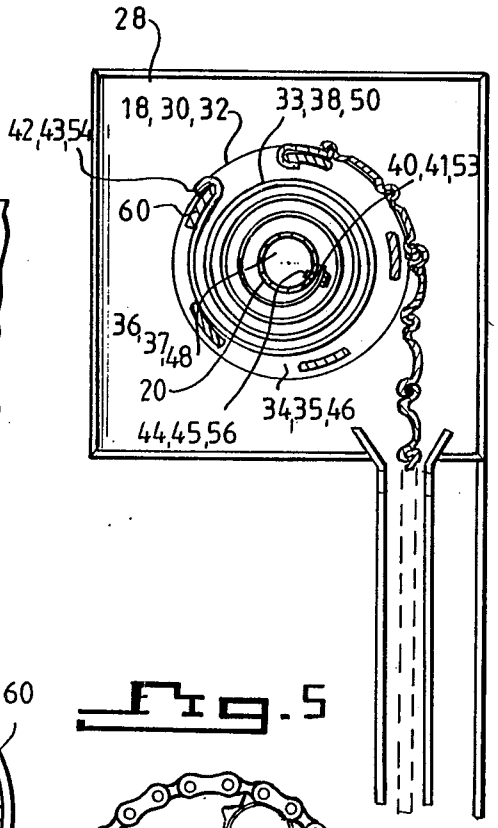
FIG. 2 is a cross-sectional view taken at line 2—2 in FIG. 3.

As shown in FIG. 2, the band spring arrangement 32 consists of an end plate 34 while the band spring 32 is bolted to the axle.

The band spring arrangement 32 further consists of a flat coil band spring 38 which has a fixed end 40 and a tongue 42. The fixed end 40 is connected to the axle pipe 20 by bolting the tongue 42 of the flat coil band spring 38 to the axle pipe 20. As can be seen, the door 14 wraps around itself.

Intermediate the end plate 26 and the independent band spring door gear motor operator 10 is disposed another band spring arrangement 30.

As again shown in FIG. 2, the band arrangement 30 consists of an end plate 46 having a central throughbore 48, through which the axle pipe 20 passes.

The band spring arrangement 30 further consists of a flat coil band spring 50 that has a fixed end 53 that is bolted to the axle. As can be seen, the door 14 wraps around itself.

Figure 4:
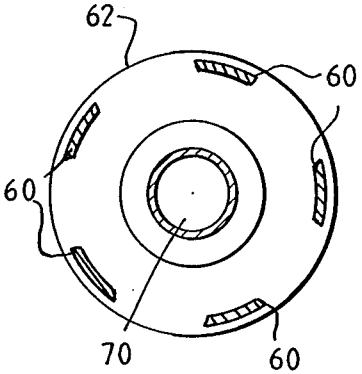
FIG. 4 is a front view of a plate shown in FIG. 3.
Figure 3:
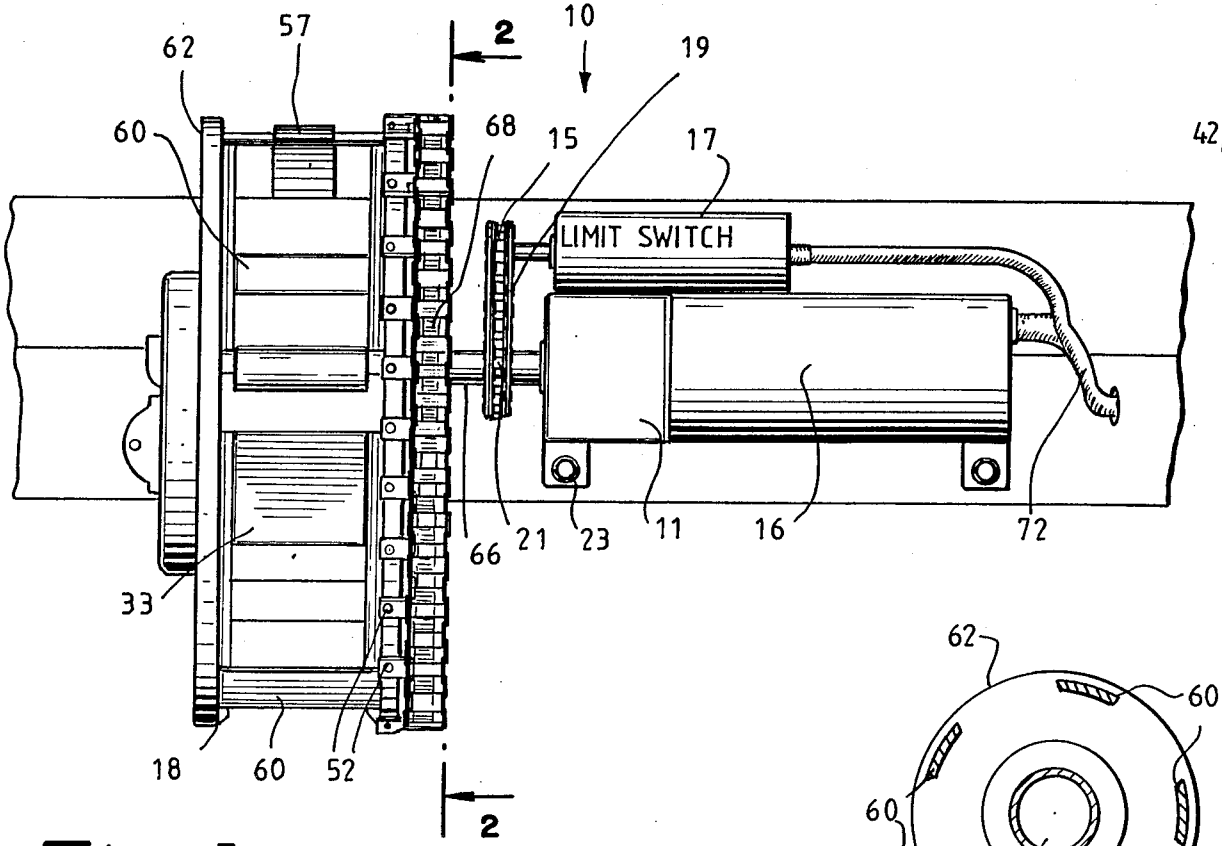
FIG. 3 is a side view, with areas cut away, of the present invention shown in FIG. 1.

The band spring cage 18, an intermediate portion 58, and the gear motor operator 11 are shown in greater detail in FIGS. 3 and 4.

The intermediate portion 58 is a ring gear sprocket 64 with a plurality of fingers 52 extending therefrom. The band spring cage 18 contains a plurality of fingers 60. The plurality of fingers 52 is optional since a solid ring 52 may work as well. The plurality of fingers 60 terminate at the plate 62 which provides the closing side for the band spring cage 18. As shown, the axle pipe 20 is stationary and passes through the band spring cage 18.

Figure 5:
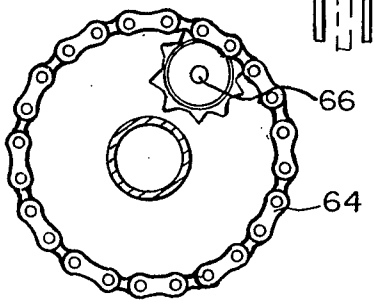
FIG. 5 is a front view of the sprocket drive shown in FIG. 3.

The gear motor operator 11 consists of a shaft 66 and a pinion gear 68 mounted to the shaft 66. As can be seen in FIGS. 3 and 5, the pinion gear sprocket 68 meshes with the roller chain ring gear 64. Thus, the band spring cage, the intermediate portion 58, the gear motor operator 11, and the gear motor 16, together now form an integral unit.

FIG. 4 shows the plate 62 with the plurality of fingers 60 extending therefrom. The axle pipe 20 is shown passing through the throughbore 70 in the plate 62.

FIG. 5 shows the roller chain 64 meshed with the sprocket gear 68 which is mounted to the shaft 66.

Now referring to FIG. 6 which shows that only a minimal amount of electrical work is necessary to operate the independent band spring door gear motor operator 10.

The gear motor operator 11 attaches to the motor 16, and both mount onto the axle pipe 20. The motor 16 is connected, via a power cord 72, to an operating switch 74. The power cord 72 then continues on to the 12 volt direct current battery 76 that could be optionally located on the axle or elsewhere.

It will be understood that each of the elements described above, or two or more together, may also find a useful application in other types of constructions differing from the type described above.

While the invention has been illustrated and described as embodied in a independent band spring door gear motor operator, it is not intended to be limited to the details shown, since it will be understood that various omissions, modifications, substitutions and changes in the forms and details of the device illustrated and in its operation can be made by those skilled in the art without departing in any way from the spirit of the present invention.

A stationary gear motor is mounted to the axle pipe and turns the band spring cage. The stationary pipe is mounted between two end plates. The stationary pipe contains one or more cages with a band spring having one end fastened to the pipe and the other end attached to the horizontal strap of the cage.

Thus, when cage rotates in the opposing direction to that of the curtain, where travel winds the band springs. After the springs are wound while in the down position, the curtain is fastened to the spring cages by means of S hook. One end of the S hook inserts into corrugation of the curtain, the other end is inserted onto an available horizontal strap of the spring cage.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A power assist device for raising and lowering an independent band spring door, comprising:

(a) prime mover means, said prime mover means include a gear motor, said gear motor is a 12 volt direct current electrical gear motor;

(b) means for controlling said prime mover means, said controlling means include a gear motor operator;

(c) a band spring cage; and (d) means for mechanically connecting said controlling means to said band spring cage, said mechanical connecting means include a planetary roller chain gear set, said planetary roller chain gear set has only a roller chain ring gear and a pinion gear sprocket.

2. A power assist device as defined in claim 1; further comprising an axle pipe having a first end and a second end and on which said small 12 volt direct current electrical gear motor, said gear motor operator, and said band spring cage are colinearly mounted.

3. A power assist device as defined in claim 2; further comprising a first end plate and a second end plate each having a throughbore in which said first end and said second end, respectively, of said axle pipe are mounted so that said throughbores in said first end plate and said second end plate function as journals.

4. A power assist device as defined in claim 3; further comprising a first band spring arrangement and a second band spring arrangement mounted on said axle pipe.

5. A power assist device as defined in claim 4, wherein said first band spring arrangement is disposed intermediate said first end plate and said band spring cage while said second band spring arrangement is disposed intermediate said second end plate and said 12 volt direct current electrical gear motor.

6. A power assist device as defined in claim 5, wherein said first band spring arrangement and said second band spring arrangement each have a plate with a substantially disposed throughbore through which said axle pipe passes.

7. A power assist device as defined in claim 6, wherein said first band spring arrangement and said second band spring arrangement each having a flat band spring with a fixed end and a tongue which is bolted, respectively, on said axle pipe, one end of said spring bolted to said axle pipe coiled around said axle pipe inside cage.

8. A power assist device as defined in claim 7, wherein said roller chain ring gear has a plurality of fingers extending therefrom and in the direction of and terminating thereon said band spring cage.

9. A power assist device as defined in claim 8, wherein said band spring cage has a plurality of horizontal straps.

10. A power assist device as defined in claim 9, wherein said band spring cage has a plate on which said plurality of horizontal straps of said band spring cage terminate.

11. A power assist device as defined in claim 10, wherein said gear motor operator has a shaft on which said pinion gear sprocket is rotatably mounted.

12. A power assist device as defined in claim 11, wherein said plate contains a central throughbore through which said axle pipe passes.

13. A power assist device as defined in claim 12, wherein said plurality of fingers extending from said roller chain ring gear is optional.

14. A power assist device as defined in claim 13, wherein said plurality horizontal straps of said band spring cage is five.

15. A power assist device as defined in claim 14, further comprising a power switch.

* * * * *